United States Patent [19]

Chiang

[11] Patent Number: 4,984,809

[45] Date of Patent: Jan. 15, 1991

[54] BALL GAME DEVICE

[76] Inventor: Hsi-Shih Chiang, 4F, No. 8-1, Lane 77, Sung-Chiang Rd., Taipei, Taiwan

[21] Appl. No.: 521,993

[22] Filed: May 10, 1990

[51] Int. Cl.[5] ..... A63B 63/02

[52] U.S. Cl. ..... 273/401

[58] Field of Search ..... 273/398, 400, 401, 402

[56] References Cited

U.S. PATENT DOCUMENTS 642,903 2/1900 Hachmuth ..... 273/401

2,647,747 8/1953 Kenney et al. ..... 273/402

4,828,270 5/1989 Chiang ..... 273/401

*Primary Examiner*—William H. Grieb

*Attorney, Agent, or Firm*—Ladas & Parry

[57] ABSTRACT

A ball game device includes a vertical panel having a through-hole; a guide member extending rearward from the periphery of the vertical panel; a basket having a net and a mounting looped frame attached to the vertical panel below the through-hole. The device further includes a guiding member for guiding the advancing ball to fall smoothly into the basket and avoiding from jumping out.

6 Claims, 4 Drawing Sheets

BALL GAME DEVICE

BACKGROUND OF THE INVENTION

This invention relates to a ball game device more particularly to a ball game device having a guiding member.

A ball game device of the prior art (U.S. Pat. No. 4,828,270) comprises a vertical panel having a through-hole, a front and a rear side; a basket having a net and a horizontal mounting looped frame for holding the net, the looped frame being attached to the vertical panel below the through-hole, a guide member extending rearward from the periphery of the vertical panel and being substantially circular in shape; said vertical panel and the guide member preferably moulded in one piece.

The disadvantages of the prior art are the following: when a ball is thrown into the through-hole, it sometimes rebounds out of said hole, and the impact of the ball is so much that said ball can not easily fall into the basket. Thus causing dissatisfaction among the players.

The present invention helps to solve the disadvantages of the prior art so as to create a pleasant game for the players.

SUMMARY OF THE INVENTION

The present invention provides a guiding member together with a screen for guiding the advancing ball into the basket and preventing it from rebounding.

The present invention provides a ball game device includes a vertical panel having a through-hole, a front side and a rear side; a bracket bar formed at the rear side of the vertical panel and below the through-hole; a guide member extending rearward from the periphery of the vertical panel and being substantially circular in shape; a basket having a net and a horizontal mounting looped frame, the looped frame being attached to the rear side of the vertical panel.

The present invention additionally includes a guiding member which is substantially surrounded by the guide member. The guiding member includes a seat and a guide plate, protruding inclinedly downward from the center of the seat and partially faces the through-hole and the looped frame. A pair of protrusions formed respectively on each side of the guide plate and protrude downwards and are smaller at the vertex than at the base.

The present invention further includes a screen between the guiding plate and the vertical panel. The screen has a width bigger than that of the through-hole.

This invention helps to reduce the impact of the advancing ball and to guide it smoothly into the basket.

BRIEF DESCRIPTION OF THE DRAWINGS

The preferred embodiment of the present invention will be better understood with the accompanying drawings, in which.

DETAILED DESCRIPTION OF THE PREFERRED EMBODIMENT

Figure 1:
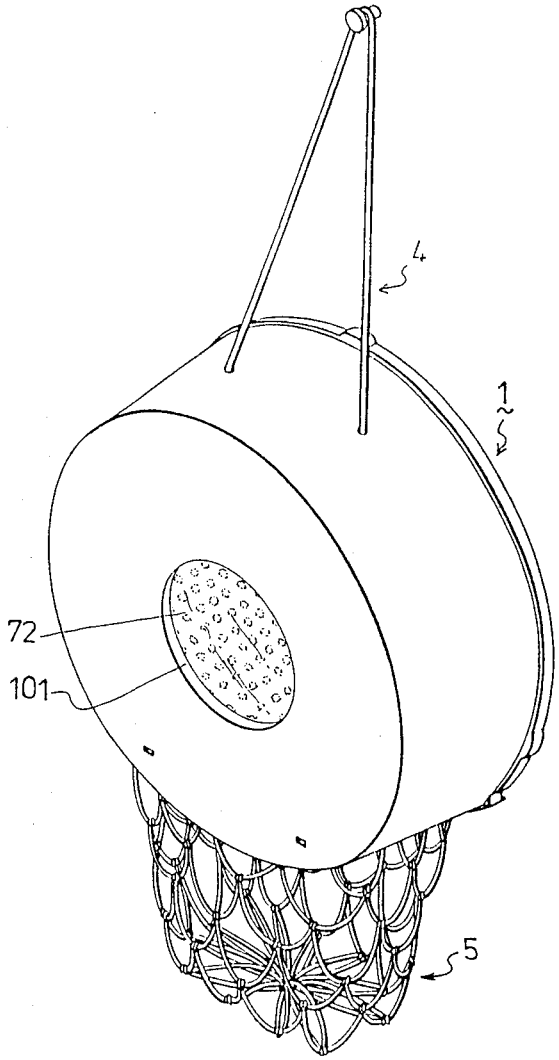
FIG. 1 is a perspective view of the present invention.
Figure 2:
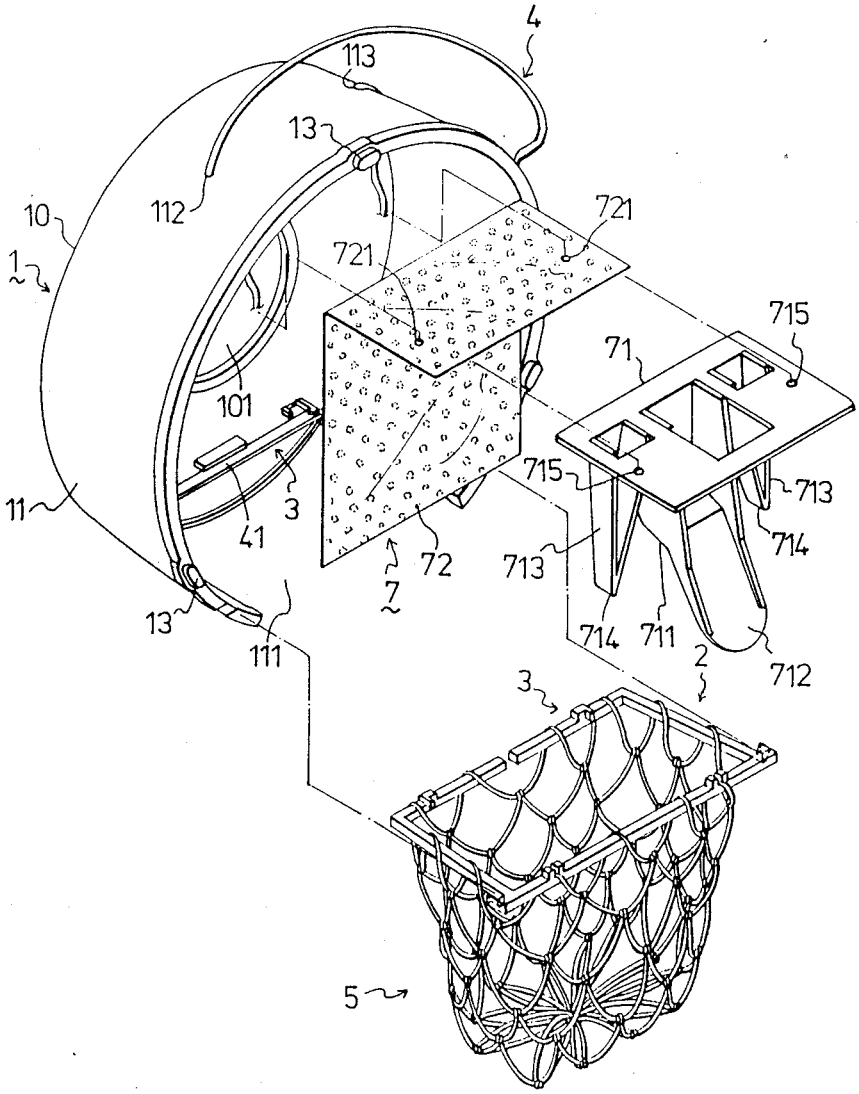
FIG. 2 is an exploded view of the FIG. 1.
Figure 3:
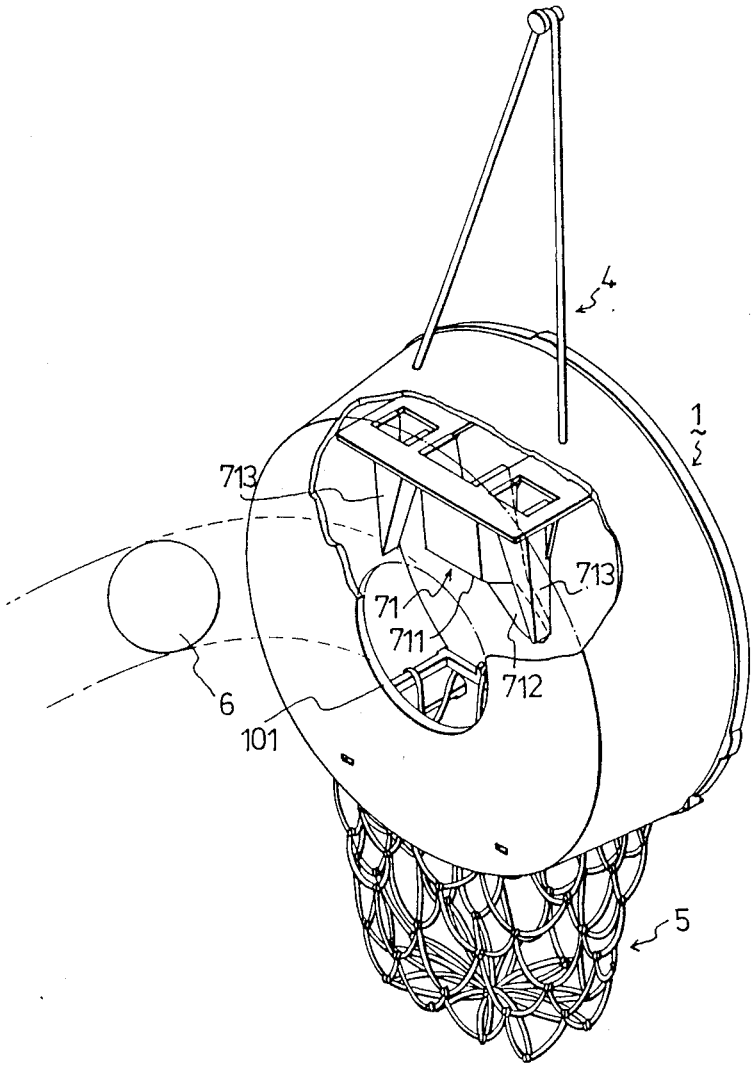
FIG. 3 is a partially sectional view of the ball game device according to FIG. 1.

Referring to FIGS. 1, 2, 3, a ball game device according to the present invention comprises a vertical panel 10 having a through-hole 101, a bracket bar 3 with a clamping member 41 formed at the rear side thereof, a substantially circumferential guide member 11 extending rearward from the vertical panel 10, a cord 4 threaded through a pair of hole 112, 113 formed in the guide member 11; a looped frame 2 with a net 5 attached to the rear side of the vertical panel 10 below the through-hole 101; and a guiding member 7 having a seat 71 and a screen 72.

Referring to FIGS. 2, 3, a guide plate 711 protrudes inclinedly from the center of the seat 71 and partially faces the through-hole 101 and the looped frame 2. A pair of protrusions 713 formed on each side of the guide plate 711 extend downward. The vertices 714 of the protrusions are smaller than at the base. The screen 72 is hung to the guide member 11 by a pair of holes 112, 113 formed in the guide member 11. In assembly, the pairs of engaging means 112, 113, 721 and 715 can be threaded to be one engaging means so as to be be positioned in the guide member 11.

Figure 4:
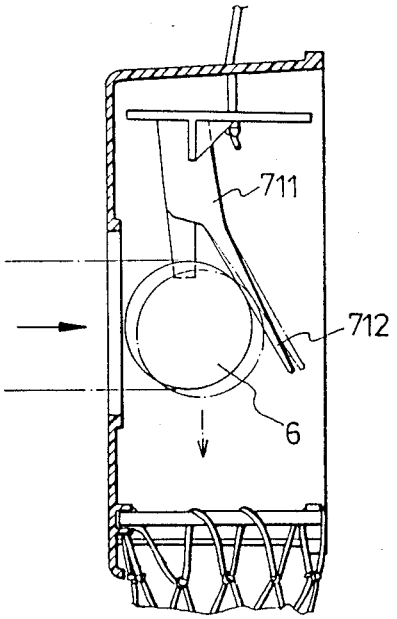
FIG. 4 is a cross-sectional view of the present invention.

Referring to FIG. 4, the advancing ball 6, first impact the screen 72, after which the guide plate 711 prevents the ball from directly hitting the wall and guides the ball smoothly into the basket.

With this invention thus explained, it is understood that several modifications and variations can be made without departing from the scope and the spirit of this invention. It is therefore, this invention be limited as indicated only in the appended claims.

I claim:

1. A ball game device comprising:

a vertical panel having a through-hole, a front side and rear side;

a basket having a net and a horizontal mounting looped frame for holding said net, said looped frame having one side attached to said vertical panel and two opposite sides adjacent to two ends of said one side of said looped frame;

a guide member attached to said vertical panel at said rear side and projecting rearward from said vertical panel, said guide member extending upward to a location above said through-hole from one of opposite sides of said looped frame and then extending downward to the other of opposite sides of said looped frame; wherein the improvement is characterized by:

a guide plate substantially surrounded by said guide member, said guide plate partially facing the through-hole of said vertical panel and partially facing said looped frame of the basket; whereby, a ball thrown into said through-hole can be smoothly guided into said basket by said guide plate, avoidirng rebounding by the repulsive force.

2. A ball game device as claimed in claim 1, wherein said guide plate is attached to said upper position of said guide member.

3. A game device as claimed in claim 1, wherein said guide plate is inclinedly formed on a seat, said seat having a pair of protrusion respectively formed on two sides of said guide plate, preventing the ball from engaging between one side of the guide plate and said vertical panel.

4. A ball game device as claimed in claim 3, wherein the distance between two facing sides of said pair of said protrusions is downwardly enlarged, forming two inclined surfaces disposed aside said through-hole of said vertical panel, so that a ball impacting thereon will be guided smoothly into said basket.

5. A ball game device as claimed in claim 1, further comprising a screen having a width bigger than that of said through-hole, being hung between said through-hole and said guide plate to buffer the impact of a thrown ball.

6. A ball game device as claimed in claim 1 further comprising a cord for hanging said device on the wall.

* * * * *